US012163421B2

(12) United States Patent
Cardiff

(10) Patent No.: US 12,163,421 B2
(45) Date of Patent: Dec. 10, 2024

(54) SYSTEMS AND METHODS FOR ANALYZING SUBSURFACE FORMATIONS

(71) Applicant: WISCONSIN ALUMNI RESEARCH FOUNDATION, Madison, WI (US)

(72) Inventor: Michael Cardiff, Madison, WI (US)

(73) Assignee: WISCONSIN ALUMNI RESEARCH FOUNDATION, Madison, WI (US)

( * ) Notice: Subject to any disclaimer, the term of this patent is extended or adjusted under 35 U.S.C. 154(b) by 0 days.

(21) Appl. No.: 18/121,904

(22) Filed: Mar. 15, 2023

(65) Prior Publication Data

US 2023/0296017 A1 Sep. 21, 2023

Related U.S. Application Data

(60) Provisional application No. 63/320,584, filed on Mar. 16, 2022.

(51) Int. Cl.
*E21B 49/00* (2006.01)
*E21B 43/12* (2006.01)

(52) U.S. Cl.
CPC ..... *E21B 49/008* (2013.01); *E21B 43/12* (2013.01); *E21B 2200/20* (2020.05)

(58) Field of Classification Search
CPC ..... E21B 47/06; E21B 49/10; E21B 21/08; E21B 43/12; E21B 44/00; E21B 47/008; E21B 43/128
See application file for complete search history.

(56) References Cited

U.S. PATENT DOCUMENTS

2023/0132593 A1* 5/2023 Fripp ..... G10K 7/06 166/281

FOREIGN PATENT DOCUMENTS

CA 3018284 A1 * 3/2019 ..... E21B 43/00
WO WO-2008055188 A2 * 5/2008 ..... E21B 43/00

OTHER PUBLICATIONS

Cardiff et al. "Analytical and Semi-Analytical Tools for the Design of Oscillatory Pumping Tests," Groundwater, vol. 53, No. 6, pp. 896-907, Nov.-Dec. 2015.
Cardiff et al, "Aquafier Imaging with Oscillatory Hydraulic Tomography: Application at the Field Scale," Groundwater, vol. 58, pp. 710-722, 2020.

(Continued)

*Primary Examiner* — Zakiya W Bates
(74) *Attorney, Agent, or Firm* — Seager, Tufte & Wickhem LLP

(57) ABSTRACT

A system for monitoring and establishing physical properties of a subsurface formation at a testing site having a source well and one or more receiver wells may include a pump, a data collection system, and a controller. The controller may cause the pump to extract fluid from and inject fluid into the source well based on one or more measures indicative of an amount of liquid in the source well. The controller may receive measures related to pressures in the receiver wells and physical properties of the subsurface formation may be determined based on the measures related to pressures in the receiver well. In some cases, noise may be removed from the measures related to pressures in the receiver wells to facilitate determining the physical properties of the subsurface formation.

10 Claims, 10 Drawing Sheets

(56) References Cited

OTHER PUBLICATIONS

Cardiff, "Characterizing Porous and Fractured Media with Oscillatory Hydraulic Tomography: Techniques, Tools and Theory," Powerpoint Presentation, 23 slides, AGU Fall Meeting 2019.
Kitanidis, "Quasi-Linear Geostatistical Theory for Inversing," Water Resources Research, vol. 31, Issue 10, pp. 2411-2419, Oct. 1995, Accessed Sep. 6, 2023. (Abstract Only).
Patterson et al., "Aquafier Characterization and Uncertainty in Multi-Frequency Flow Tests: Approach and Insights," pp. 1-12, Sep. 7, 2021.
Sayler et al., "Understanding the Geometry of Connected Fracture Flow with Multiperiod Oscillatory Hydraulic Tests," Groundwater, 12 pages, 2017.

* cited by examiner

SYSTEMS AND METHODS FOR ANALYZING SUBSURFACE FORMATIONS

CROSS-REFERENCE TO RELATED APPLICATIONS

This application claims the benefit of U.S. Provisional Patent Application Ser. No. 63/320,584, filed Mar. 16, 2022, which is incorporated herein by reference.

STATEMENT REGARDING FEDERALLY SPONSORED RESEARCH OR DEVELOPMENT

This invention was made with government support under EAR1215746 and 1654649 awarded by the National Science Foundation and under FS-98597713-0 awarded by the Environmental Protection Agency. The government has certain rights in the invention.

TECHNICAL FIELD

The present disclosure pertains to testing systems and assessment tools, and the like. More particularly, the present disclosure pertains to subsurface testing and assessment systems and systems for determining properties of subsurface formations.

BACKGROUND

Subsurface formations may include subsurface reservoirs and formations that directly or indirectly connect subsurface reservoirs. A subsurface reservoir may be a subsurface space containing one or more recoverable natural resources, a subsurface space used to treat a transport fluid (e.g., a geothermal reservoir), etc. Various techniques, systems, and tools are known for assessing subsurface formation. Of the known approaches and systems for determining and/or assessing properties of a subsurface formation, each has certain advantages and disadvantages.

SUMMARY

This disclosure is directed to several alternative designs for, devices of, and methods of using testing systems and assessment tools. Although it is noted that testing and assessment approaches and systems are known, there exists a need for improvement on those approaches and systems.

Accordingly, one illustrative instance of the disclosure may include a system comprising a pump configured to be positioned proximate a wellhead of a source well to extract fluid from and inject fluid into the source well, a data collection system configured to monitor one or more measures indicative of an amount of liquid in the source well, a controller in communication with the pump and the data collection system. The controller may be configured to cause the pump to extract the fluid from and inject the fluid into the source well based on the one or more measures indicative of an amount of liquid in the source well.

Additionally or alternatively to any of the embodiments in this section, the data collection system may include at least one sensor configured to sense a measure related to fluid injection and extraction rates at the source well.

Additionally or alternatively to any of the embodiments in this section, the at least one sensor may comprise a first sensor configured to remain in the liquid at the source well during changes in an amount of fluid extracted from and injected into the source well and a second sensor configured to remain out of the liquid at the source well during changes in the amount of fluid extracted from and injected into the source well.

Additionally or alternatively to any of the embodiments in this section, the at least one sensor at the source well may be configured to sense a measure related to pressure at the source well.

Additionally or alternatively to any of the embodiments in this section, the data collection system may include at least one sensor at a receiver well that is spaced a known distance from the source well, the at least one sensor may be configured to sense a measure related to pressure changes at the receiver well.

Additionally or alternatively to any of the embodiments in this section, the data collection system may include at least one sensor at each of a plurality of receiver wells that are spaced a known distance from the source well, the at least one sensor at each of the plurality of receiver wells may be configured to sense a measure related to pressure changes at an associated receiver well.

Additionally or alternatively to any of the embodiments in this section, the data collection system may include at least one sensor at the source well, the at least one sensor at the source well may be configured to sense a measure related to fluid injection and extraction rates at the source well.

Additionally or alternatively to any of the embodiments in this section, the controller may be configured to receive data from the at least one sensor at the source well, receive data from the sensors at the receiver wells, and produce a model of a subsurface formation between the source well and the plurality of receiver wells based on data received from the at least one sensor at the source well and data received from the sensors at the receiver wells.

Additionally or alternatively to any of the embodiments in this section, the model may be configured to identify transmissivity and storativity properties in the subsurface formation.

Additionally or alternatively to any of the embodiments in this section, the system may further comprise a valve, wherein the controller is in communication with the valve to cause the pump to extract fluid from and inject fluid into the source well in a sinusoidal manner.

In another illustrative instance of the disclosure, a controller may comprise a processor, an input/output (I/O) port in communication with the processor, and memory configured to store instructions executable by the processor to cause the processor to output a control signal via the I/O port to cause a pump to extract fluid from and inject fluid into a source well in a sinusoidal manner at one or more frequencies, receive via the I/O port sensed values of measures related to pressure in one or more receiver wells spaced from the source well, and produce physical parameters of a subsurface formation between the source well and the one or more receiver wells based on the sensed values of measures related to pressure in the one or more receiver wells.

Additionally or alternatively to any of the embodiments in this section, the physical parameters may be produced in a three-dimensional model of the subsurface formation between the source well and the one or more receiver wells.

Additionally or alternatively to any of the embodiments in this section, the physical parameters may provide transmissivity information for the subsurface formation between the source well and the one or more receiver wells.

Additionally or alternatively to any of the embodiments in this section, the instructions executable by the processor may be further configured to cause the processor to receive sensed values of measures related to pressure in the source well, and use the sensed values of measures related to pressure in the source well to remove noise from the sensed values of measures related to pressure in the one or more receiver wells.

Additionally or alternatively to any of the embodiments in this section, the instructions executable by the processor may be further configured to cause the processor to adjust the control signal based on the sensed values of measures related to pressure in the one or more receiver wells.

Additionally or alternatively to any of the embodiments in this section, the instructions executable by the processor may be further configured to cause the processor to output the control signal based on a configuration of the source well relative to the one or more receiver wells.

Additionally or alternatively to any of the embodiments in this section, the instructions executable by the processor may be further configured to cause the processor to adjust the control signal to cause the pump to extract fluid from and inject fluid into the source well in a sinusoidal manner at different frequencies over time.

In another illustrative instance of the disclosure a method may be provided for determining properties of a subsurface formation. The method may include applying sinusoidal pressure at a source well, obtaining values related to pressure at two or more receiver wells, removing noise from the values related to pressure at the two or more receiver wells to obtain filtered values related to pressure at the two or more receiver wells, and determining properties of the subsurface formation between the source well and the two or more receiver wells based on the filtered values related to pressure at the two or more receiver wells.

Additionally or alternatively to any of the embodiments in this section, applying the sinusoidal pressure at the source well may include applying the sinusoidal pressure at different frequencies over time based on values related to pressure in the source well.

Additionally or alternatively to any of the embodiments in this section, the method may further comprise determining the different frequencies over time based on a configuration of the source well relative to the two or more secondary wells.

The above summary of some example embodiments is not intended to describe each disclosed embodiment or every implementation of the disclosure.

BRIEF DESCRIPTION OF THE DRAWINGS

The disclosure may be more completely understood in consideration of the following detailed description of various embodiments in connection with the accompanying drawings, in which.

Figure 1:
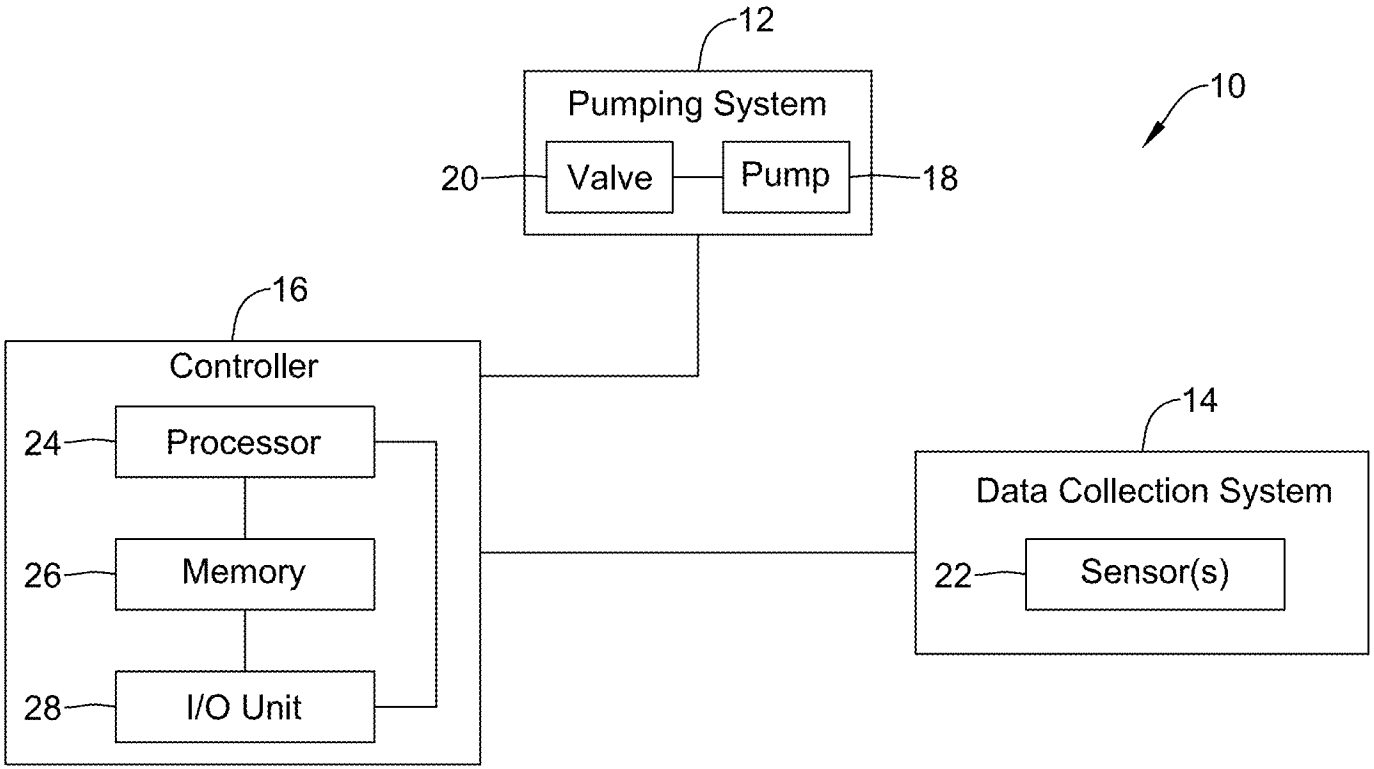
FIG. 1 is a schematic box diagram of an illustrative system for testing and/or assessing properties of a subsurface formation.

While the disclosure is amenable to various modifications and alternative forms, specifics thereof have been shown by way of example in the drawings and will be described in detail. It should be understood, however, that the intention is not to limit aspects of the claimed disclosure to the particular embodiments described. On the contrary, the intention is to cover all modifications, equivalents, and alternatives falling within the spirit and scope of the claimed disclosure.

DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges, and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the claimed disclosure. The illustrative embodiments depicted are intended only as exemplary. Selected features of any illustrative embodiment may be incorporated into an additional embodiment unless clearly stated to the contrary.

Knowledge concerning subsurface properties and/or parameters may be used in fields where flow of fluids through porous media or fractured media is relevant. Example fields include, but are not limited to geothermal exploration and geothermal reservoir operation fields, oil and gas extraction fields, groundwater contaminant remediation fields, and/or other suitable fields.

Knowledge of physical properties of subsurface structures and/or formations is important for a number of commercially relevant systems, including well, geothermal, oil, and gas systems, among other systems. Successful implementation of such systems may require accurate information on hydraulic properties that control fluid flow (e.g., size, orientation, flow, transport, permeability, hydraulic conductivity, transmissivity, storativity, complexity, and/or other parameters or properties related to subsurface configurations) through subsurface structures and/or formations (e.g., through fields).

An accurate prediction of physical properties of subsurface formations may be beneficial when, among other times, core material (e.g., material removed from the subsurface formation at the time of forming a wellbore) cannot be obtained due to cost or poor recovery of the core material, there are no borehole (e.g., central lumen) image logs, and/or beneficial in other suitable instances. Additionally, decreasing a cost of exploitation for oil wells, gas wells, geothermal reservoirs, and/or other suitable subsurface systems may be achieved by reducing uncertainty in estimations of subsurface properties and/or parameters.

Characterizing physical properties governing flow and transport in aquifers is an initial step in groundwater investigations and has significant implications for groundwater resource management and contaminant remediation strategies. See Patterson, J. R., and Cardiff, M., Sep. 7, 2021, Aquifier Characterization and Uncertainty in Multi-Frequency Oscillatory Flow Tests: Approach and Insights, *Groundwater*, https://doi.org/10.1111/gwat.13134, which is hereby incorporated by reference in its entirety for any and all purpose. Characterizing (e.g., through imaging and/or simulation) physical properties governing flow and transport, such as permeability, hydraulic conductivity, transmissivity, and storativity, in aquifers and/or reservoirs remains a fundamental challenge in hydrogeology. The limited ability to "see" into the subsurface has an effect of limiting the predictive ability to simulate reservoir or aquifer properties.

Near-surface geophysical methods may be utilized to image spatial variability in hydraulic properties. The non-uniqueness of geophysical responses, challenging geologic materials (e.g., highly resistive materials), and unreliable petrophysical relationships using near-surface geophysical methods highlights the need for additional information when characterizing hydraulic properties.

Measuring borehole pressure propagation during hydraulic testing and then processing the collected data in a tomographic manner—i.e., hydraulic tomography—provides a direct approach to imaging the structures controlling subsurface flow and storage. Like other geophysical imaging methods, hydraulic tomography parameterizes the spatial variability in hydraulic properties in a flexible manner and quantifies how the properties between sources (pumping locations) and receivers (pressure observation locations) impacts collected data.

Oscillatory hydraulic tomography (OHT) is a minimally-invasive hydraulic testing method for imaging the subsurface structures that control flow and storage of fluids in the subsurface. OHT uses oscillatory hydraulic pressure signals at a source well to image multi-scale subsurface parameters (e.g., hydraulic properties) using recorded pressure signals from the source well and/or receiver wells in a field. In some cases, OHT samples subsurface heterogeneity across multiple scales by changing the frequency of the pumping signal. A benefit of OHT over traditional hydraulic tomographic testing may be an ability to extract a pressure signal from instrument drift, signal noise, or other hydrologic noise imprinted upon the recorded pressure time-series data.

Techniques (e.g., including, but not limited to, OHT), for testing and/or assessing properties of subsurface formations (e.g., geologic reservoirs that contain fluids and/or other suitable subsurface formations) may include pumping fluid in one well (e.g., a source well) and monitoring pressure responses at other wells (e.g., receiver wells) to characterize properties of the subsurface formation between and/or around the well at which pumping is performed and the wells at which pressure responses are monitored. At operational fields (e.g., an operating geothermal reservoir and/or other suitable operational fields), however, any pumping test signal detected at a well at which a pressure response is monitored may be mixed with and corrupted by other operations (e.g., pressures, stresses, etc.) or natural changes (e.g., river stage changes, evapotranspiration, etc.) at or near the operational field.

Techniques for testing and/or assessing physical properties of subsurface formations (e.g., geologic reservoirs that contain fluids and/or other suitable subsurface formations) discussed herein may facilitate characterizing the transmissivity and/or storativity of the subsurface formations despite noise at a testing site. The disclosed concepts provide systems and techniques for controlling pressures within a source well and sensing pressures (e.g., at discrete locations) in one or more receiver wells in response to the controlled pressures, where signals corresponding to pressures in response to the controlled pressure may be extracted from noise (e.g., where the noise may be sensed signals from the other operations at or near the operational field and/or other suitable noise). Such systems and techniques facilitate testing and/or monitoring subsurface formations without major changes or cessation of existing on-site operations.

The system may include, among other components, an apparatus capable of producing changes (e.g., sinusoidal changes and/or other suitable changes) in an amount of fluid (e.g., water, gas, and/or other suitable fluid) extracted and/or injected into a source well, one or more pressure sensors at each of the source well and receiver wells spaced a known distance from and around the source well, and a central data collection system (e.g., which may or may not include the pressure sensors at the source well and/or the receiver wells). The central data collection system may be capable of recording well injections rates, well extraction rates, injection and extraction times, injection and extraction durations or periods, pressures at the source well, pressures at the receiver wells, sampling times, and/or other suitable data.

The system may assess and/or monitor collected data in view of well configurations to 1) control injection and extraction rates and amplitude at a source well and/or 2) separate pressure responses at one or more receiver wells in response to fluid injection and/or extraction at the source well from noise at the operational field. Such noise separation, may facilitate providing improved values of or indicative of subsurface formation parameters (e.g., improved estimates of aquifer/reservoir permeability, estimates of relative saturations of multiple fluid phases, aquifer/reservoir storage coefficients, information about connectivity between wells, and/or other suitable parameters).

The system may be utilized to determine or suggest optimal experimental setups and/or adjustments (e.g., based on collected data, field or location geometries, field or location constraints, and/or other suitable information) and efficient compression and/or analysis of data collected from initial tests and/or the suggested tests. For example, based on initial estimates of aquifer/reservoir properties and the constraints of the oscillating flow system (e.g., total volume that may be extracted, maximum frequency that may be obtained by controller), the amplitude and period of additional periodic testing may be optimized to obtain maximum signal amplitude and thus maximum reliability and minimal uncertainty in detected signals. See e.g., Cardiff, M., Barrash, W., 2015. Analytical and Semi-Analytical Tools for the Design of Oscillatory Pumping Tests, Groundwater 53, 896-907, https://dx.doi.org/10.1111/gwat.12308, which is hereby incorporated by reference in its entirety and for all purposes.

Turning to the Figures, FIG. 1 depicts a system 10 for testing and/or assessing properties or conditions of a subsurface formation. In some cases, the system 10 may be configured to test, establish, and/or monitor permeability, storage coefficients, and/or connectivity information of subsurface formation(s) extending about or otherwise around a well (e.g., and/or a wellbore of a well).

The system 10 may include, among other components, a pumping system 12, a data collection system 14, and a controller 16. In some cases, the system 10 may be a closed loop system in which the pumping system 12 may be controlled by the controller 16 in view of data collected with the data collection system 14 and/or a setup of wells at a testing site.

The pumping system 12 may be any suitable type of pumping system 12 configured to inject and/or extract fluid into or from a wellbore associated with the pumping system 12 to change pressures therein in response to control signals from the controller 16. In one example, the pumping system 12 may be or may include an oscillating pumping system configured to pump air and/or other fluid into and/or out of a source well. Other suitable pumping systems 12 are contemplated.

The pumping system 12 may include, among other components, a pump 18 and a valve 20. Though not required, the pump 18 may be configured to set an amplitude of pressure in the wellbore and the valve 20 may be configured to determine a frequency of a sinusoidal pressure in the wellbore.

The pump 18 may be any suitable type of pump including, but not limited to, a hydraulic pump, a pneumatic pump, and/or other suitable type of pump. Among other suitable components, the pump 18 may include a motor and a piston, where the motor may control operation of the piston in response to control signals from the controller 16 that are configured to determine a pumping volume, pressure, and/or rate, but this is not required. In one example configuration, the controller 16 may cause the pump 18 to pump fluid into the source well and/or extract fluid from the source well in response to data from one or more sensors 22 at the source well to achieve a desired pressure value and/or liquid level in the source well.

The valve 20 may be any suitable valve including, but not limited to, an electronically controlled valve 20. In some cases, the valve 20 may be configured to open and/or close in response to control signals from the controller 16 so as to oscillate fluid at a known rate, but this is not required. The valve 20 may be configured to open or close at any suitable rate. In one example, the controller 16 may cause the valve 20 to open and close at a rate between 0.10 hertz (Hz) and 0.25 Hz (e.g., sinusoidal period in a range of four (4) to ten (10) seconds). In another example, the controller 16 may cause the valve 20 to open and close at a rate of 0.25 Hz, but other suitable rates are contemplated.

In addition to or alternatively to the pump 18 and the valve 20, the pumping system 12 may include one or more other suitable components to facilitate pumping fluid at wells and/or other suitable locations. In one example, the pumping system 12 may include, among other features, one or more processors, memory, input/output (I/O) units, communication components, user interfaces, touch screens, display screens, selectable buttons, housings, a wellhead cap to trap fluid in the well and/or to interface with the pump, and/or other suitable components configured to facilitate pumping fluids at wells and/or other suitable subsurface formations. In some cases, the pump 18 and/or the valve 20 may be or may include computing devices or controllers having memory, one or more processors, and/or other suitable components of computing devices.

The data collection system 14 may be any suitable type of sensing and/or collection system configured to sense pressure changes in well(s) in response to fluid injected into and/or extracted from the source well associated with the pumping system 12. In one example, the data collection system 14 may include, among other components, one or more sensors 22 in communication with the controller 16. The one or more sensors 22 may be configured to sense pressures and/or measures related to pressures at wells (e.g., source wells, receiver wells, etc.)

In addition to or alternatively to the sensors 22, the data collection system 14 may include one or more other suitable components to facilitate sensing pressures at wells and/or other suitable locations and collecting data from the sensors 22. In one example, the data collection system 14 may include, among other features, one or more processors, memory, input/output (I/O) units, communication components, user interfaces, touch screens, display screens, selectable buttons, housings, and/or other suitable components configured to facilitate collecting data from wellbores and/or other suitable data concerning subsurface formations. In some cases, the sensors 22 may be or may include computing devices having memory, one or more processors, and/or other suitable components of computing devices The sensors 22 of the data collection system 14 may be located at each of two or more wells (e.g., the source well, one or more receiver wells, and/or other suitable wells). In some cases, the wells may include two sensors, where a first sensor 22 is configured to be positioned in liquid (e.g., water and/or other suitable liquid) within a well and remain in the liquid during a test and a second sensor 22 is configured to be positioned out of the liquid and remain out of the liquid during the test. When so configured, a pressure difference between the first and second sensors 22 may be indicative of a liquid amount (e.g., a water level/elevation or other suitable liquid level) in the wellbore and the pressure difference and/or liquid amount may be collected and stored in memory. In some cases, the pressure difference between the first and second sensors 22 and/or the liquid amount in the source well may be utilized to control the pumping system 12 and/or analyzing measures from sensors 22 in a receiver well. Alternatively or additionally to using the first and second sensors 22, the wells may include only a single sensor, sensors separated by packers, and/or other suitable configurations of sensors.

The sensors 22 may be any suitable type of sensor 22 configured to sense one or more measures related to pressure in the wells. For example, the sensors 22 may be fiber optic sensors, pressure transducers, force sensors, gage pressure sensors, absolute pressure sensors, differential pressure sensors, and/or other suitable sensors. In one example configuration, one or more of the sensors 22 may be and/or may include a fiber optic pressure transducer attached to a light source, but this is not required and other suitable types of sensors 22 are contemplated.

The sensors 22 may be configured to take measurements at any suitable rate. In some cases, the sensors 22 may be configured to have a measurement frequency of at least 1 Hz, of at least 50 Hz, or at least 100 Hz. In one example, one or more of the sensors 22 may have a measurement frequency of 125 Hz.

The sensors 22 may be located at any suitable locations within the well. In some cases, the sensors may be located at between one (1) meter and twenty (20) into a well from the top of the well. Other suitable positions of the sensors 22 within the wells are contemplated.

When included, optical pressure sensor types of sensors 22 (e.g., transducers) may be a mechanical system that blocks light as the pressure changes (e.g., increases). In some suitable optical pressure sensors 22, phase differences of light may be detected to facilitate making accurate measurements of small pressure changes. In one example configuration of an intensity-based optical pressure sensor 22, the sensor 22 may include a light source and/or emitter (e.g., a light emitting diode and/or other suitable light source/emitter), a light detector (e.g., a photodiode and/or other suitable light detector), and an element (e.g., a reflector) that changes position in response to changes in pressure (e.g., a reflective diaphragm and/or other suitable element configured to change position in response to pressure changes). In some cases, a fiber optic cable including one or more optical fibers may be utilized to transport emitted light from the light source to the reflector and/or reflected light from the reflector to the light detector.

In such a sensor 22 configured as an optical pressure sensor, light may be provided by the light source/emitter down a source fiber to the element that changes position in response to pressure changes, the element that changes position reflects an amount or intensity of light received from the light source/emitter to a detector fiber (e.g., where the source fiber and the detector fiber may be the same or different fibers), and the light detector may detect the amount/intensity of the reflected light and provides a parameter value associated with the detected light to a data collector/analyzer (e.g., the controller 16, a computing component of the data collection system 14, and/or other suitable collector/analyzer). As the amount of detected light has a known relationship with a sensed pressure, the data collector/analyzer and/or other suitable system may determine a pressure sensed by the sensor 22. Other suitable sensor 22 configurations and techniques for sensing pressure in wells with the sensors 22 are contemplated.

The sensors 22 may be wired or wireless sensors. When wired, the sensors 22 may include among other wired components a fiber optic cable or fiber in communication with the controller 16 and/or other suitable components including or in communication with the light detector and the light emitter. When wireless, the sensors 22 may include the light detector and the light emitter and communicate with the controller 16 or other suitable components of the system 10 over one or more wireless and/or wired networks. Further, when wireless (or wired), the sensors 22 may include timing controllers (e.g., where the timing controllers utilize GPS (Global Positioning System) time measurements and/or other accurate time measurements) that facilitate achieving consistent measurement of phases of pressure waves.

The controller 16 may be any suitable controller configured to control the pumping system 12 and/or process the data of or from the data collection system 14. The controller 16 may be a component that is separate from the pumping system 12 and/or the data collection system 14, as depicted in FIG. 1, and/or the controller 16, or a portion of the controller 16, may be a component of or otherwise included in the pumping system 12 and/or the data collection system 14. In some cases, the controller 16 may be or may include a PID controller (proportional-integral-derivative controller) to facilitate a closed loop control of the pumping system and/or for other purposes, but this is not required.

As depicted in FIG. 1, the controller 16 may be in communication with the pumping system 12 and the data collection system 14. In some cases, the controller 16 may be configured to receive data from and/or control the pumping system 12 and the data collection system 14. The controller 16 may determine physical properties and/or other suitable properties or conditions (e.g., which may or may not be related to the physical properties) of a subsurface formation around or between wells based on at least the control of the pumping system 12 and collected data from the data collection system 14 and/or a configuration of the wells at the testing site or location. Example properties or conditions of subsurface formations include, but are not limited to, aquifer/reservoir transmissivity, aquifer/reservoir storage (e.g., storativity, etc.) coefficients, connectivity between wells, etc. Example data that the controller 16 may receive from the data collection system 14 may include, but is not limited to, values related to pressure sensed by the sensors 22, well location data, sensor location data, an identifier for a sensor 22 sensing the data, an identifier of the wellbore associated with the sensor 22 sensing the data, time data associated with values related to pressures sensed, etc.

Additionally to or alternatively to receiving data from the data collection system 14, the controller 16 may determine control operations for the pumping system 12 to effect pressure changes in the wellbores (e.g., in response to sensed pressures) and/or receive an input of a value related to how the pumping system 12 is to be controlled to effect pressure changes in the wellbores. In some cases, the controller 16 may be configured to determine one or more properties or conditions of the formation extending around and/or between wells and/or control operations for the pumping system 12 based on the received values related to pressure at the wells sensed by the sensors 22 and a current control configuration of the pumping system 12.

In some cases, the controller 16 may be in a single housing. Alternatively, the controller 16 may be implemented in two or more housings. Further, in some cases, at least part of the controller 16 may implemented in or on a remote server (e.g., in a cloud system) and communicate with one or more other components of the controller 16 over one or more wired and/or wireless networks.

The illustrative controller 16 may include, among other suitable components, one or more processors 24, memory 26, and/or I/O units 28. Other suitable example components of the controller 16 that are not depicted in FIG. 1 may include, but are not limited to, communication components, a user interface, a touch screen, a display screen, selectable buttons, a housing, a pump controller for controlling stress applied to a wellbore, and/or other suitable components of a controller 16. As discussed above, one or more components of the controller 16 may be separate from the pumping system 12 and/or the data collection system 14, as depicted in FIG. 1, and/or incorporated into the pumping system 12 and/or the data collection system 14.

The processor 24 of the controller 16 may include a single processor or more than one processor working individually or with one another. The processor 24 may be configured to execute instructions, including instructions that may be loaded into the memory 26 and/or other suitable memory. Example components of the processor 24 may include, but are not limited to, microprocessors, microcontrollers, multi-core processors, central processing units, graphical processing units, digital signal processors, application specific integrated circuits (ASICs), field programmable gate arrays (FPGAs), discrete circuitry, and/or other suitable types of data processing devices.

The memory 26 of the controller 16 may include a single memory component or more than one memory component each working individually or with one another. Example types of memory 26 may include random access memory (RAM), EEPROM, FLASH, suitable volatile storage devices, suitable non-volatile storage devices, persistent memory (e.g., read only memory (ROM), hard drive, Flash memory, optical disc memory, and/or other suitable persistent memory) and/or other suitable types of memory. The memory 26 may be or may include a non-transitory computer readable medium. The memory 26 may include instructions executable by the processor 24 to cause the processor to effect the methods and/or techniques discussed herein.

The I/O units 28 of the controller 16 may include a single I/O component or more than one I/O component each working individually or with one another. Example I/O units 28 may be or may include any suitable types of communication hardware and/or software including, but not limited to, communication ports configured to communicate with the pumping system 12, the data collection system 14, and/or other suitable computing devices or systems. Example types of I/O units 28 may include wired ports, wireless ports, radio frequency (RF) ports, Low-Energy Bluetooth ports, Bluetooth ports, Near-Field Communication (NFC) ports, HDMI ports, WiFi ports, Ethernet ports, VGA ports, serial ports, parallel ports, component video ports, S-video ports, composite audio/video ports, DVI ports, USB ports, optical ports, and/or other suitable ports.

Figure 2:
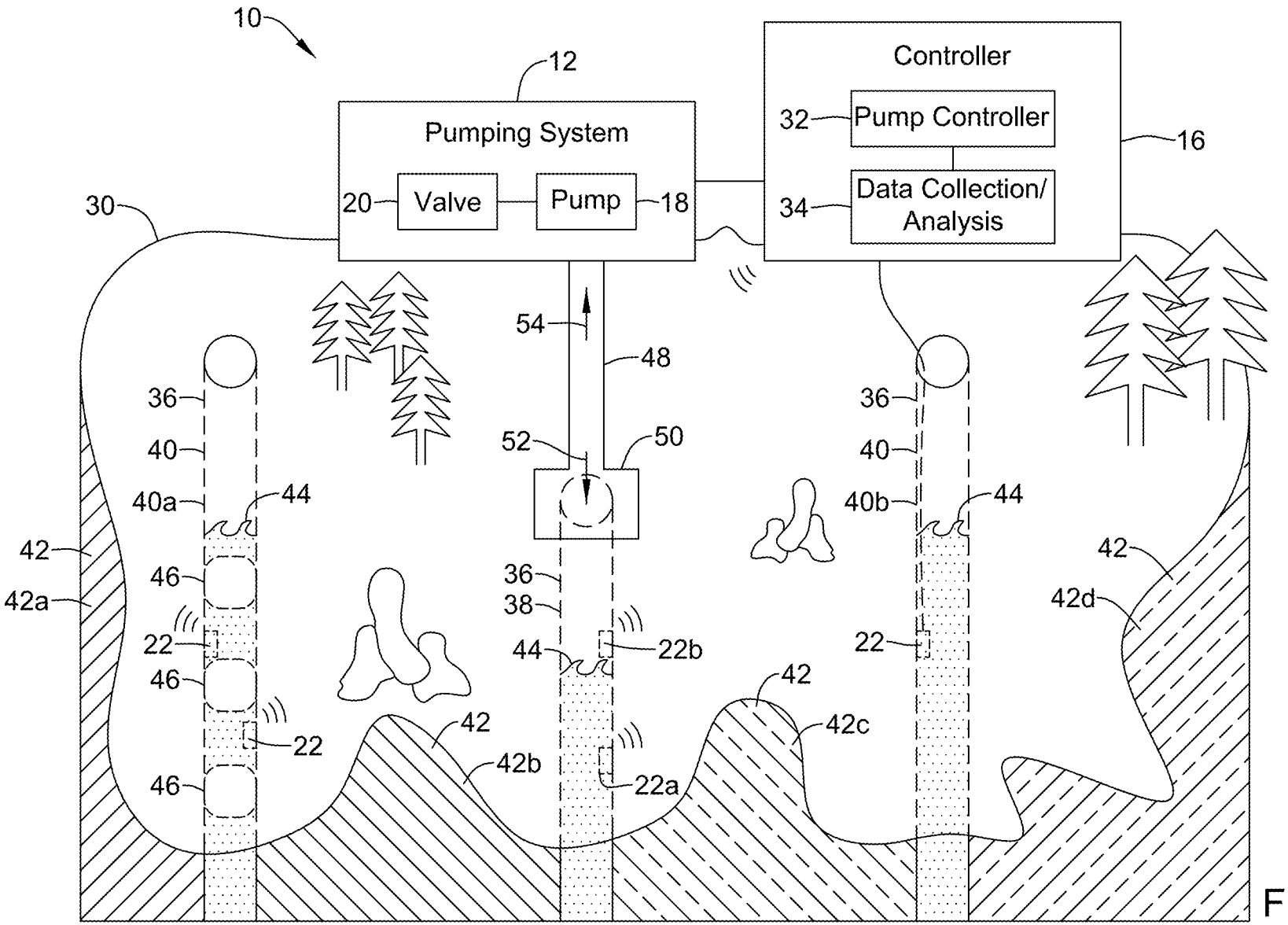
FIG. 2 is a schematic diagram of an illustrative subsurface formation testing site and an illustrative system for testing and/or assessing properties of a subsurface formation at the testing site.

FIG. 2 is a schematic diagram of an illustrative subsurface formation testing site 30 and the system 10 for testing and/or assessing properties of a subsurface formation 42 at the testing site 30. As depicted in FIG. 2, the system 10 includes the pumping system 12 and the controller 16. In some cases, the controller 16 may incorporate at least part of a pump controller 32 and a data collection and/or analysis component 34. In one example, the pump controller 32 may be configured to control operation of the pumping system 12 in response to data collected and/or analyzed at the data collection and/or analysis component 34. The data collection and/or analysis component 34 may be part of the data collection system 14, but this is not required.

The testing site 30 may be any suitable site at which it may be desirable to determine properties of subsurface formations 42. At the testing site 30, one or more wells 36 may be drilled to facilitate testing and/or sensing subsurface formations 42. In some cases, the wells 36 may include one or more source wells 38 and one or more receiver wells 40.

The one or more receiver wells 40 may be spaced a known distance from the source well(s) 38. For example, the one or more receiver wells 40 may be spaced a known distance from the source well(s) 38 that is in a range of one (1) meter (m) to fifty (50) m, a range of five (5) m to twenty-five (25) m, and/or other suitable range. In one example, the one or more receiver wells 40 may be spaced a known distance from the source well(s) 38 that is equal to or greater than fifteen (15) m.

The wells 36 may be any suitable type of well. In one example, one or more of the wells 36 may be an "open hole" well 36, where a subsurface formation 42 (e.g., rock or other suitable formation) may be solid enough that a well bore naturally stays open. In another example, the one or more of the wells 36 may be "screened" wells 36, where a well casing (e.g., a plastic casing, a PVC (polyvinylchloride) casing, a metal casing, etc.) is inserted into a wellbore and slits or openings may be provided in the well casing such that subsurface formation water flows into and out of the well and pressure communication exists between the well 36 and the subsurface formation 42. Screened wells 36 may be utilized at any suitable location including, but not limited to, at wells 36 located within shallow unconsolidated subsurface formations. Other suitable configurations for wells 36 are contemplated.

The testing site 30 may have a plurality of subsurface formations 42. As depicted in FIG. 2, the testing site 30 may have a first subsurface formation 42*a*, a second subsurface formation 42*b*, a third subsurface formation 42*c*, and a fourth subsurface formation 42*d*, but testing sites 30 may have any suitable number of subsurface formations having similar or different material properties to one another. Although the subsurface formations 42 between the wells 36 are depicted as being homogenous, the subsurface formations 42 at various locations may include one or more types of subsurface formations 42.

In the setup depicted in FIG. 2, the system 10 may be configured to test and analyze the second subsurface formation 42*b* which is between the source well 38 and a first receiver well 40*a*, along with the third subsurface formation 42*c* between the source well 38 and a second receiver well 40*b*. The system 10 may be configured to test and/or analyze the second subsurface formation 42*b* and the third subsurface formation 42*c* simultaneously and/or individually.

To facilitate testing and analyzing the subsurface formations 42, the source well 38 well may be equipped with a first sensor 22*a* and a second sensor 22*b*. In some cases, the first sensor 22*a* may be positioned in the source well 38 so as to remain in liquid 44 (e.g., water and/or other suitable liquid) and the second sensor 22*b* may be positioned in the source well 38 so as to remain out of the liquid 44 while fluid is injected into and extracted out of the source well 38. When the first sensors 22*a* remains in the liquid and the second sensor 22*b* remains out of the liquid, a difference between the measurements of the first and second sensors 22*a*, 22*b* taken at a same or nearly same time may be indicative of a level (e.g., an elevation, etc.) of the liquid 33 in the source well 38.

The one or more receiver wells 40 (e.g., the first receiver well 40*a* and the second receiver well 40*b*) may include one or more sensors 22. As depicted in FIG. 2, the first receiver well 40*a* includes two sensors 22 (e.g., wireless sensors configured to wireless communicate with the controller 16) that are located in the liquid 44 and the second receiver well 40*b* includes a single sensor 22 (e.g., a wired sensor configured to communicate with the controller 16 via a wired connection) that is located in the liquid 44. Other suitable wireless and wired sensor configurations are contemplated.

Although the receiver wells 40 are depicted as including sensors 22 only in the liquid 44 and only requiring a single sensor 22 in the liquid 44, one or more sensors 22 may be positioned in the receiver wells 40 at a location that is configured to be outside of the liquid 44. When the receiver wells 40 include a sensor 22 at a location outside of the liquid 44, measurements from the sensor 22 located outside of the liquid 44 may measure an ambient or barometric pressure at the receiver well 40 and the ambient pressure may be utilized to normalize data from the sensor 22 in liquid at the receiver well 40, but this is not required.

In some cases, a receiver well 40 may include a plurality of sensors 22 in the liquid 44 for sensing pressure at a plurality of locations in the receiver well 40. For example, as depicted in FIG. 2, the first receiver well 40*a* may include two sensors 22, where each sensor is configured to sense or measure a pressure at different discrete locations in the first receiver well 40*a* that are separated by packers 46.

The packers 46 may be any suitable type of packer configured to fluidly separate locations or portions of the first receiver well 40*a* from other locations or portions of the first receiver well 40*a*. In one example, the packers 46 may be inflatable to secure the packers 46 at a desired location in the central lumen 60 and may be inflated by pumping a fluid into the packers with a pumping system (not shown). Other suitable packers 46 and/or packer configurations are contemplated. Further, although the packers 46 may be configured to prevent fluid from moving between locations within the first receiver well 40*a*, the fluid may transfer between locations of the first receiver well 40*a* by exiting the first receiver well 40*a* at a first location and reentering the first receiver well 40*a* at a second location that is fluidly isolated within the first receiver well 40*a* from the first location.

When a receiver well 40 includes two or more sensors 22 at locations of the receiver well 40 fluidly isolated from one another, the measurements from the sensors 22 may be utilized to determine material properties of subsurface formations at different elevations of the subsurface formation. In one example, where a first location is a lower elevation than a second location fluidly isolated from the first location, measurements from a first sensor 22 sensing pressure within the receiver well 40 at the first location that are a lower pressure than the measurement from a second sensor sensing pressure at the second location within the receiver well 40 may indicate that a subsurface formation at the lower elevation between the source well 38 and the receiver well 40 may be less porous than a subsurface formation at the higher elevation between the source well 38 and the receiver well 40.

The pumping system 12 may be positioned at a wellhead and may fluidly couple to the source well 38 in any suitable manner. In some cases, a tube structure 48 may be fluidly coupled to the pumping system 12 (e.g., fluidly coupled to the pump 18) and fluidly coupled to a wellhead cap 50 having a fluid tight seal (e.g., a hermetic seal) with a wellhead of the source well 38. The pump 18 of the pumping system 12 may be configured to pump or otherwise inject fluid into the source well 38 via a lumen of the tube structure 48 and the wellhead cap 50 in a direction of arrow 52 and withdraw or otherwise extract fluid from the source well via the same path in a direction of arrow 54. Although fluid is depicted as being pumped into and withdrawn from the source well 38 via a same path in FIG. 2, the input and withdrawal of fluid may follow paths through separate tube structures or separate lumens in a single tube structure, where the separate lumens may be separated by a lumen wall or other suitable structure.

Figure 3:
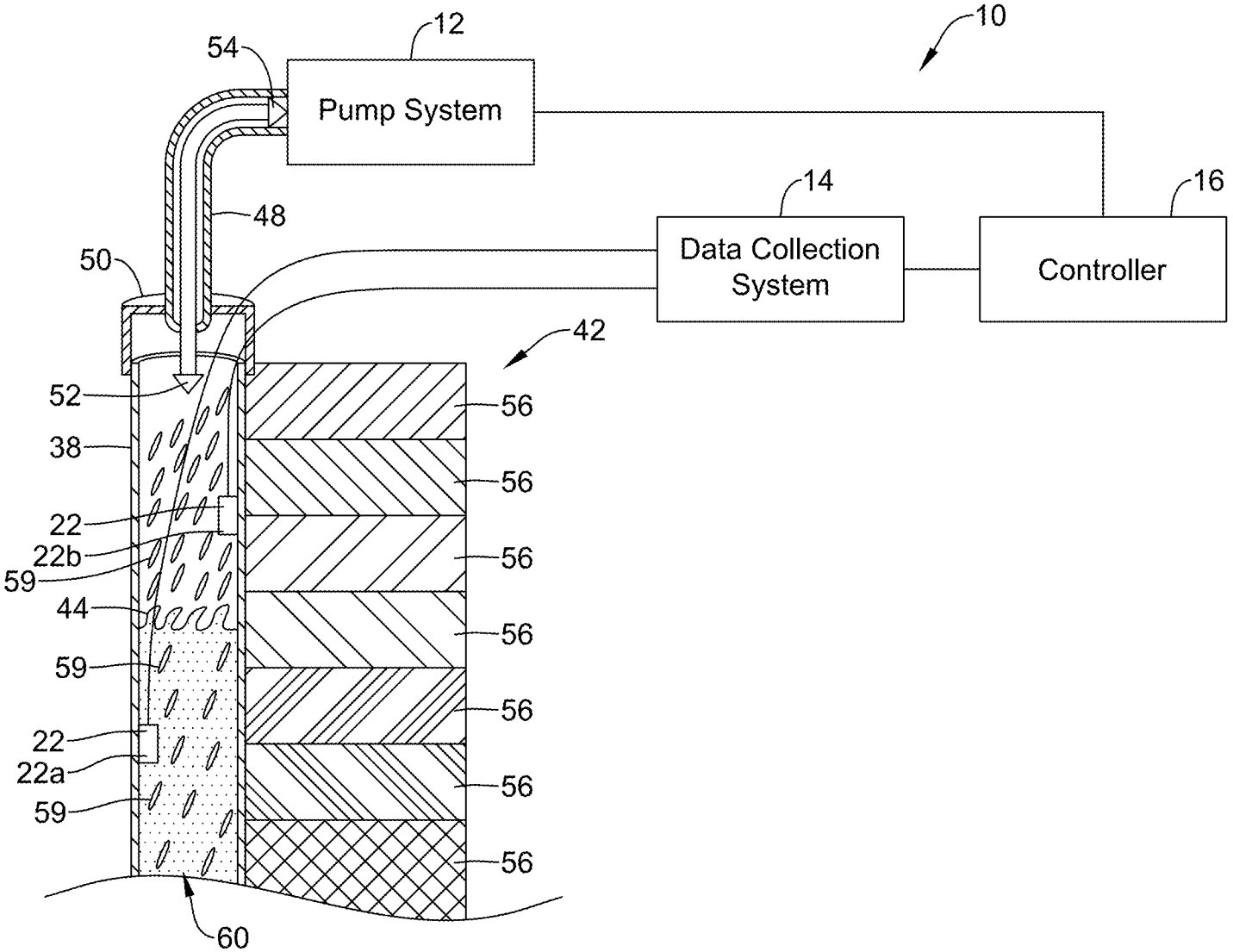
FIG. 3 is a schematic diagram of an illustrative system for testing and/or assessing properties of a subsurface formation at a wellbore.

FIG. 3 is a schematic partial cross-sectional diagram of the system 10 for testing and/or assessing properties or conditions of a subsurface formation. In FIG. 3, the well 36 (e.g., the source well 38) and the subsurface formation 42 are depicted in a schematic cross-sectional view, while the pump system 12, the data collection system 14, and the controller 16 are schematically depicted in a box diagram. The well 36, as depicted in FIG. 3, may be a "screened" well having a PVC casing 58 with opening or slits 59 therein to allow water to flow into and out of the well 36 and put the well 36 in pressure communication with the subsurface formation 42. Other suitable configurations for the well 36 are contemplated.

The subsurface formation 42 may be formed from one or more suitable layers 56 of material. The layers 56 of material forming the subsurface formation 42 may be any suitable type of material and may have any suitable size. In some cases, the subsurface formation 42 may have a single layer 56 of material extending an entire length of the well 36 or two or more layers 56 of material extending along the length of the well 36. Example layers of material include, but are not limited to, sand, topsoil, solid rock (e.g., granite, etc.), stones, clay, water, oil, sandstone, limestone, shale, carbonate, ash, and/or other suitable geologic materials (e.g., metamorphic, sedimentary, and/or igneous rocks/soil).

Each layer 56 of the subsurface formation 42 may be considered to have its own physical properties and/or other suitable properties or conditions due to, among other factors, how the layer 56 was formed, when the layer 56 was formed, and/or what materials are in the layer 56. In some cases, two adjacent layers of the same general material may have different physical properties and/or other suitable properties or conditions based on how and/or when the layer was formed as well as the constituent makeup of the material.

A type, size, physical properties, and/or other suitable properties or conditions of the layers 56 and/or the overall subsurface formation 42 may be determined from subsurface formation core samples extracted when forming the well 36 and/or exploring where to position the well, but sometimes it is not possible to analyze a core sample due to costs, poor recovery of the core sample, and/or due to other suitable reasons. In cases when it is not possible to analyze core samples and/or in other cases, it may be possible to determine type, size, physical properties, and/or other suitable properties or conditions of the layers 56 of the subsurface formation 42 and/or the overall subsurface formation 42 with the system 10 via data captured by the pump system 12 and the data collection system 14, as referred to above and discussed in greater detail below.

The well 36 may take on any suitable configuration extending through the subsurface formation 42. In one example, the well 36 may have the PVC casing 58 with slits 59 extending through the casing to the subsurface formation 42, as discussed above, where the PVC casing 58 defines a central lumen 60 (e.g., a passageway) for fluid and/or components to pass through the well 36. Other suitable configurations of the well 36 and/or the casing 58 are contemplated.

As shown in FIG. 3, the first sensor 22*a* and the second sensor 22*b* may be positioned along an inner surface of the casing 58 of the well 36. As depicted, the first sensor 22*a* may be positioned in the liquid 44 and the second sensor 22*b* may be positioned out of the liquid 44. When so positioned, the measurements from the sensors 22*a*, 22*b* may be utilized to determine a liquid amount in the source well 38. Additionally or alternatively, the measurements from the sensors 22 at the source well 38, the liquid amount, and/or other parameters may be indicative of or otherwise related to fluid injection and extraction rates of the pumping system 12.

In some cases, pressure changes may be applied to the source well 38 via the pumping system 12 based on the liquid amount in the well 36 and/or measurements from sensors 22 in the receiver wells 40. Additionally or alternatively to using sensed measurements to control the pumping system 12, the measurements from the sensors 22 may be analyzed to model the subsurface formations 42 (e.g., at layers 56 and/or as a whole) between the source well 38 and the receiver wells 40 and/or provide suggested changes to a test set up. For example, based on initial estimates of aquifer/reservoir properties and the constraints of the oscillating flow system (e.g., total volume that may be extracted, maximum frequency that may be obtained by controller, etc.), the amplitude and period of additional periodic testing may be determined (e.g., optimized) to obtain desired (e.g., maximum) signal amplitude and thus desired (e.g., maximum) reliability and desired (e.g., minimal) uncertainty in signals. Cardiff, M., Barrash, W., 2015, Analytical and Semi-Analytical Tools for the Design of Oscillatory Pumping Tests, Groundwater 53, 896-907, https://dx.doi.org/10.1111/gwat.12308, which has been incorporated by reference herein, discusses one example of utilizing initial estimates of aquifer/reservoir properties and constraints of the oscillating flow system to obtained desired amplitude and periods for periodic testing of the aquifer/reservoir properties.

Figure 4:
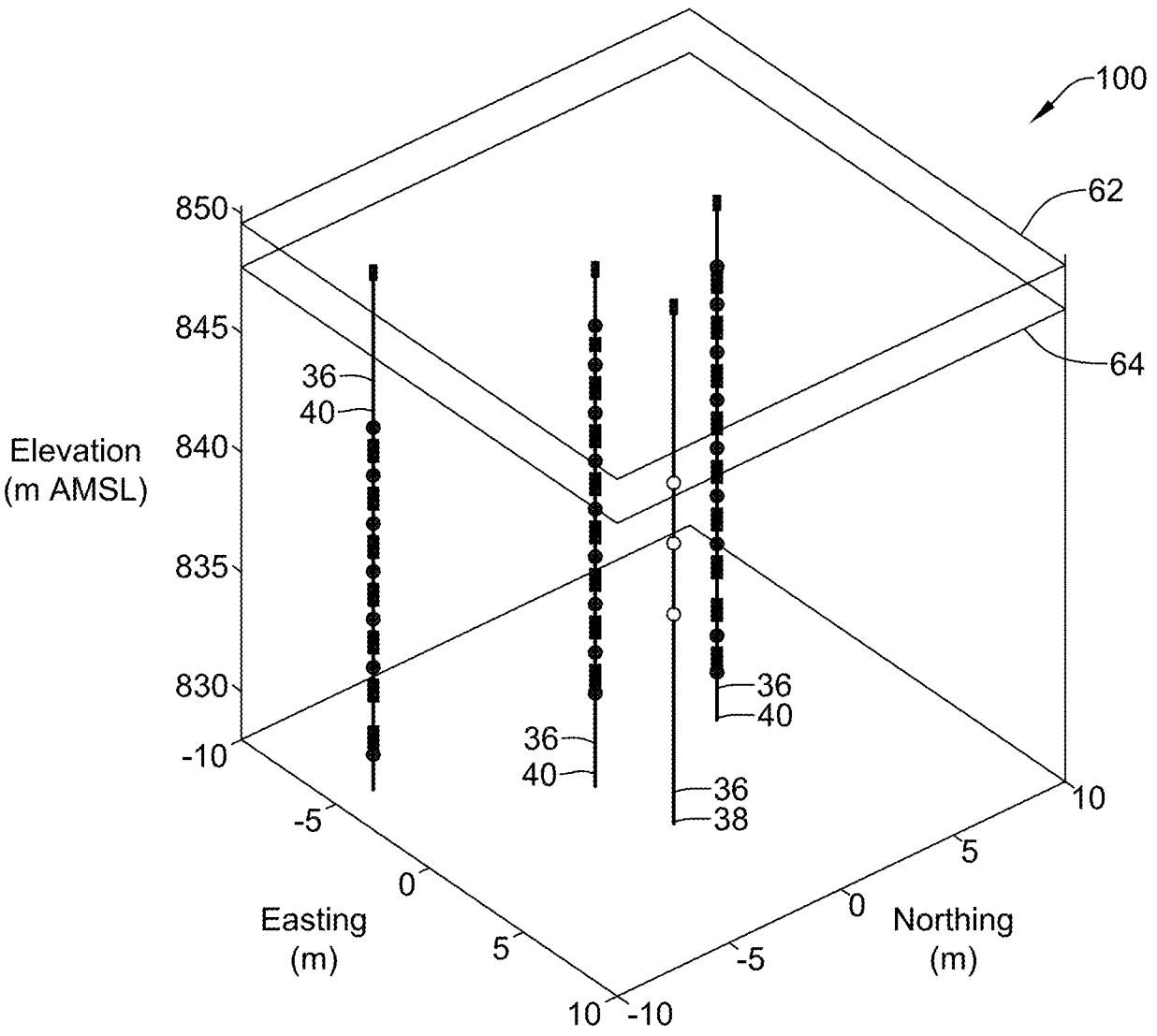
FIG. 4 is a schematic chart of a set up for an illustrative system for testing and/or assessing properties of a subsurface formation at a subsurface formation testing site.

FIG. 4 is a schematic chart 100 of an example testing site set up for the using the system 10 to test and/or assess properties of a subsurface formation at a subsurface formation testing site (e.g., the testing site 30 and/or other suitable testing site). The testing site referred to in the chart 100 covers a twenty (20) m by twenty (20) m area (e.g., a grid from −10 m to +10 m by −10 m to +10 m) and the wells 36 extend between from about eight hundred thirty (830) m above mean sea level (AMSL) to about eight hundred fifty (850) m AMSL. Further, a land plane 62 represents an approximate location of a surface at the testing site and a liquid plane 64 represents an approximate location of a water table.

As depicted in FIG. 4, the example testing set up includes a source well 38 having three pressure application locations (represented by open circles) at different depths in the source well 38. Further, the testing set up may include three receiver wells 40 that each have a plurality of sensing locations (represented by filled-in circles) that are separated by packers (represented by filled-in rectangles). Such a configuration may allow collection of data at different elevations, which facilitates modeling the properties of subsurface formations at different layers. Further, in some cases, each well 36 may be plugged at the top with a packer, but this is not required.

Figure 5:
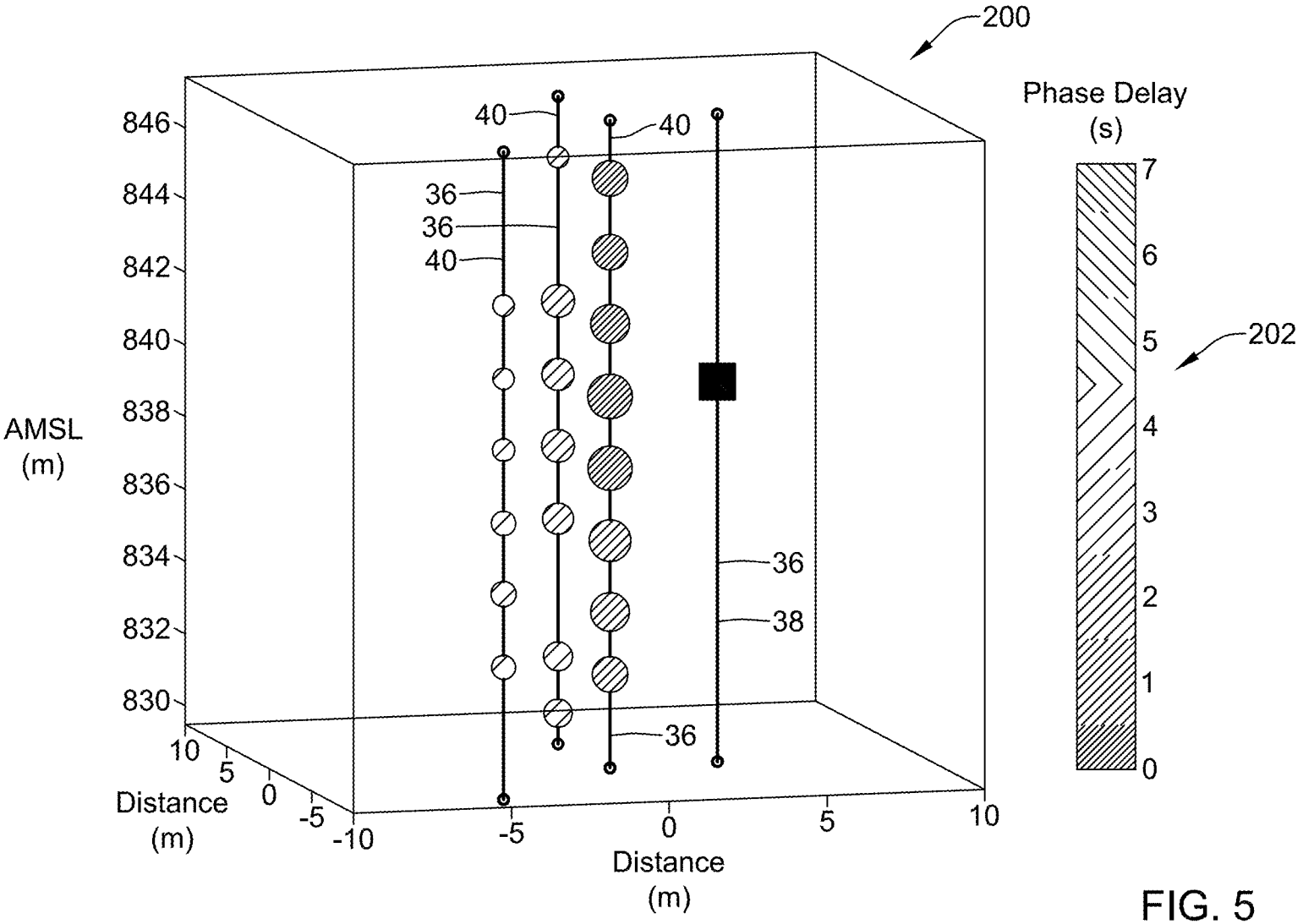
FIG. 5 is a schematic chart of data for a subsurface formation testing site that were obtained from an illustrative system for testing and/or assessing properties of a subsurface formation at the testing site.

FIG. 5 is a schematic chart 200 of data from a sample test using the system 10 at a subsurface formation testing site. The testing site covers a twenty (20) m by twenty (20) m area and the wells 36 extend between about eight hundred thirty (830) m (AMSL) to about eight hundred forty-six (846) m AMSL.

As depicted in FIG. 5, the setup of the testing site for the test may include a source well 38 having a pressure application location (represented by a black square) at different depths. Further, the testing set up may include three receiver wells 40 that each have a plurality of sensing locations (e.g., represented by circles). The sensing locations for each receiver well 40 are at different elevations and in some cases, sensors (e.g., sensors 22 and/or other suitable sensors) in the receiver wells 40 may be separated by packers, but this is not required.

The size of a circle at the sensing locations is proportional to the amplitude of a pressure change sensed at that location. The hatching in the circle reflects a phase delay between when a pressure increase occurred at the source well 38 and when a pressure change was detected at the receiver well 40. A phase delay key 202 provides a chart for indicating time in seconds (s) of the phase delay at each sensing location.

As can be inferred from the chart 200, the pressure changes appeared to pass more quickly at higher elevations than at lower elevations. Further, greater pressures appear to have been sensed in the receiver wells 40 at similar elevations to an elevation of the pressure application location. However, as subsurface formations change between testing sites and change over time, other testing sites and/or other testing set ups may produce different results.

Figure 6:
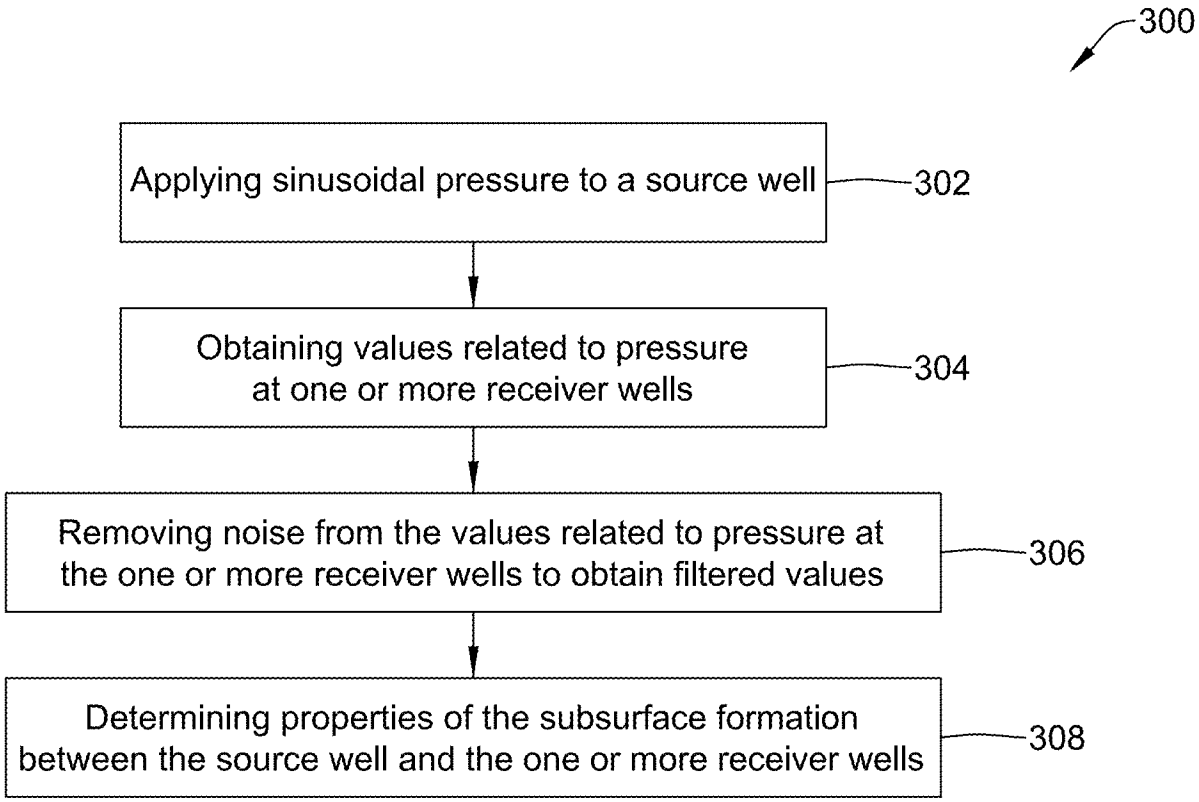
FIG. 6 is a schematic diagram of an illustrative technique for determining properties of a subsurface formation.

FIG. 6 depicts a schematic diagram of an illustrative technique or method 300 for determining properties of a subsurface formation using a system configured for testing and/or assessing properties or conditions of subsurface formations (e.g., the system 10 and/or other suitable systems). The method 300 may include applying the system to one or more wells (e.g., the wells 36 and/or other suitable wells) at a testing site (e.g., the testing site 30 and/or other suitable testing sites).

The method 300 may include applying sinusoidal or other pressure patterns to a source well (e.g., the source well 38 and/or other suitable source wells). The sinusoidal pressure may be applied using a controller (e.g., the controller 16 and/or other suitable controllers) with a fluid pumping system (e.g., the pumping system 12 and/or other suitable pumping systems) to pump fluid (e.g., air or other suitable fluid) into and/or out of the source well at a known and desired amplitude and period or frequency. In some cases, a pump (e.g., the pump 18 and/or other suitable pumps) may be utilized to set the pressure amplitude and a valve (e.g., the valve 20 and/or other suitable valve) may be utilized to set the period or frequency, but this is not required and other configurations may be utilized to set the amplitudes and/or periods or frequencies.

Any suitable period of the sinusoidal pressure may be utilized. In one example, the period of the sinusoidal pressure may be set to be in a range of four (4) seconds to five (5) minutes, four (4) seconds to ten (10) seconds, and/or other suitable range. In one example, the period of the sinusoidal pressure may be set to four (4) seconds. In another example, the period of the sinusoidal pressure may be set to four (4) minutes. Other suitable periods for the sinusoidal pressure are contemplated.

In some cases, pressures and/or a liquid amount (e.g., a water level) in the source well may be measured by sensors (e.g., the sensors 22 and/or other suitable sensors) in response to the sinusoidal pressure applied thereto, as discussed herein. A liquid amount in the source well may be determined or estimated based on a difference of a measurement from a sensor located in liquid in the source well and a sensor in the source well that is located out of the liquid.

The measured and/or calculated pressures and/or liquid amount may be utilized by a data collection system (e.g., the data collection system 14 and/or other suitable data collection systems) and/or the controller to adjust operation of the pumping system to ensure a desired pressure and/or liquid amount or change in desired pressure and/or liquid amount is achieved in the source well. In one example, the sinusoidal pressure may be applied at or to the source well at different frequencies and/or amplitudes over time based on values related to sensed pressures in the source well (e.g., values of sensed pressure, values related to liquid elevation, etc.) In some cases, such control of the frequencies and/or amplitudes of pressure applied to the source well may be a closed-loop or partially closed-loop control configuration. Additionally or alternatively to setting the frequencies and/or amplitudes based on values related to sensed pressures in the source well, the frequencies and/or amplitudes of pressure applied or to be applied at the source well may be determined based on a configuration (e.g., location, depth, etc.) of the source well relative to the one or more receiver wells and/or values sensed at the receiver wells.

In one example controller configuration (e.g., a controller configuration for the pump controller 32 and/or other suitable controller) configured to control the pumping system to extract and inject a desired amount of fluid out of and into, respectively, the source well for achieving desired pressures at the source well, the controller may be configured as a PID (proportional-integral-derivative) controller. General, PID controllers are well known control systems and may follow a feedback loop.

In the example, the PID controller may have a feedback loop that creates a control signal for the pumping system (e.g., for the pump and/or the valve) to achieve a set point value for a parameter (e.g., set point for a pressure such as a barometric pressure, a wellhead pressure, and/or other suitable pressure, a set point for a liquid level in the source well, a frequency of pressure, etc.) that follows a desired time profile. In general, the PID controller may determine the control signal by calculating an error, which may be a difference between the set point value for the parameter and a sensed value for the parameter. The calculated error may comprise or be a function of a current error (e.g., a difference between the set point value for the parameter and a measured or calculated value for the parameter), an integrated error (e.g., an expected future error between the setpoint value and the measured or calculated value for the parameter), and an error derivative (e.g., a rate at which the error is changing). The current error, the integrated error, and the error derivative may be multiplied by Proportional (P), Integral (I), and Derivative (D) control constants, respectively, and added to the previous control signal from the controller. This process may be repeated over time and, in this manner, the controller may provide at least a partially closed-loop control of the pumping system.

The closed-loop process may be done at any suitable rate. In one example, the PID controller may perform the feedback loop at a rate of forty (40) times per second, which facilitates allowing the system to achieve a desired time profile for the set point value.

In some cases, the desired time profile may be controlled by a user via a user interface in combination with ramp up/ramp down controls and/or sinewave controls. When utilized, the ramp up/ramp down controls may allow a user to raise and/or lower the desired control signal for the pumping system to a specified value at specified rates of change. When utilized, a sinewave control may allow a user to superimpose a sinewave with a specified amplitude, period, and number of cycles to achieve a desired set point value.

As and/or after the sinusoidal pressures are applied to the source well, the method 300 may include obtaining 304 values related to pressure at one or more receiver wells (e.g., the receiver wells 40 and/or other suitable receiver wells), which may be referred to as an "observation signal". In one example, observation signals may be obtained from two or more wells, but this is not required.

The observation signals from the receiver wells may be sensed with one or more sensors. In some cases, sensors at the receiver wells may be positioned so as to sense pressures at different discrete locations within the wells, which may be separated by packers or other suitable components configured to block fluid within the wells, but this is not required.

To facilitate determining what values of the observation signals at the receiver well are associated with the sinusoidal pressure applied at the source well, noise may be removed 306 from the values related to pressure at the one or more receiver wells to obtain filtered values related to pressure at the one or more receiver wells. The noise may be removed and filtered values may be obtained by processing the observation signals at the receiver wells based on the period of the sinusoidal pressure applied at the source well. In one example, Fourier coefficients may be extracted from the observation signal, where the Fourier coefficients may be indicative of physical properties of subsurface formations (e.g., flow parameters, such as diffusivity, storativity, etc.)

Any suitable technique may be utilized for removing noise from observation signals to obtain filtered values. In some cases, a technique utilizing least squares fitting Fourier coefficients to periodic data, with covariance propagation for Fourier coefficient error estimates may be utilized for noise removable from observation signals. In one example in which noise is removed from observation signals obtained at a receiver well (e.g., from sensors at the receiver well) that is a specified distance (d) from a source well, the observation signals from the receiver well may be represented by the following combination of sinusoids and observational noise:

$$h(d,t)=\varphi_r \cos(\omega t)-\varphi_i \sin(\omega t)+\varepsilon(t) \tag{1}$$

where t is time, $\omega$ is the angular frequency in radiance of pressure in the source well during testing, $\varphi_r$ and $\varphi_i$ are the real and imaginary Fourier coefficients, respectively, and $\varepsilon$ is the observation noise. The element $\omega$ may be represented by:

$$\omega=2\pi/P \tag{2}$$

where P is the stimulation period, in seconds (s), of the sinusoidal pressure applied at the source well. Given the observation signal of Equation (1), Equation (1) can be rewritten as a matrix system of equations where the Fourier coefficients are the only unknown:

$$h = X\varphi + \varepsilon,\ X = \begin{bmatrix} \cos(\omega t_1) & \cdots & -\sin(\omega t_1) \\ \vdots & & \vdots \\ \cos(\omega t_n) & \cdots & -\sin(\omega t_n) \end{bmatrix},\ \varphi = \begin{bmatrix} \varphi_r \\ \varphi_i \end{bmatrix} \tag{3}$$

wherein $$\varphi = \begin{bmatrix} \varphi_r \\ \varphi_i \end{bmatrix}$$

are extracted Fourier coefficients, and h is an observation signal.

For the purpose of this example, the Fourier coefficients for an observation signal with one frequency component may be determined, but the analysis may be extended to observation signals with multiple frequency components by expanding X and $\varphi$ to include additional sinusoidal terms and Fourier coefficients.

Taking a least-squares approach, the Fourier coefficients and their associated error may be estimated as:

$$\hat{\varphi}=(X^TX)^{-1}Xh \tag{4}$$

$$R=\sigma^2(X^TX)^{-1} \tag{5}$$

where R is the n×n data error covariance matrix and n is the number of data points (i.e., the number of extracted Fourier coefficients).

A misfit between the modeled signal using the optimal Fourier coefficients ($\hat{\varphi}$) and the observation signal (h), may provide an estimate of the variance ($\sigma^2$) of the observation signal noise ($\varepsilon$). Linear theory may be utilized to quantify the data error (i.e., covariance matrix [R]) assuming $\varepsilon$ is proportional to $N(0, \sigma^2)$, $N(0,\sigma^2)$ represents normal distribution having a mean of zero (0) and a covariance of $\sigma^2$.

Further, optimal flow parameters may be determined. To do so, the following objective function may be minimized, which may be equivalent to maximizing the likelihood of aquifer flow parameters given the available data:

$$\min_{s} \frac{1}{2}(\varphi - h(s))^T R^{-1}(\varphi - h(s)) \tag{6}$$

where h(s) is the forward model that may take aquifer flow parameters (s) as inputs and outputs Fourier coefficients. For the case of multi-frequency inversion, R is a block-diagonal matrix where the diagonal is populated by the covariance matrix for each frequency component. To conduct this inversion, the Levenberg-Marquardt algorithm may be applied, where the gradient at each iteration may be determined by numerically approximating the Jacobian matrix with the updated parameters.

Following inversion, the determined optimal flow parameters may be used as inputs to quantify parameter uncertainty through linearized error propagation. First, the m×m Jacobian matrix (i.e., parameter sensitivity matrix) may be numerically approximated by making small perturbations to the optimal parameters, where m is the number of optimal aquifer flow parameters quantified. Next, the Jacobian matrix is used to calculate the parameter covariance matrix given by:

$$\mathrm{Cov}(s^*)=(J(s^*)^T R^{-1}(J(s^*))^{-1} \tag{7}$$

Where J is the Jacobian matrix at the optimal parameters, and s* is the vector of optimal aquifer flow parameters. The diagonal elements of the parameter covariance matrix represent the posterior variance of the estimated aquifer flow parameters.

Using the above least-squares fitting to sinusoidal signals technique, testing site noise may be removed from the observation signals sensed at the receiver wells to obtained the filtered values. The above described technique for removing signals from the observation signals is further described in detail in Patterson, J. R., and Cardiff, M., Sep. 7, 2021, Aquifer Characterization and Uncertainty in Multi-Frequency Osclilatory Flow Tests: Approach and Insights, Groundwater, pages 3-5, https://doi.org/10.1111/gwat.13134, which has been incorporated by reference herein.

The method 300 may further include determining 308 properties of the subsurface formation between the source well and the one or more receiver wells. In some cases, the properties of the subsurface formation that may be determined are transmissivity and storativity of the subsurface formation. Additionally or alternatively, other suitable properties of the subsurface formation may be determined.

In some cases, the filtered values related to pressure at the one or more receiver wells may be utilized to determine properties of the subsurface formation. In one example, filtered values may be obtained for various sinusoidal pressures applied to the source well that have different periods or frequencies and/or amplitudes. The filtered data associated with the various sinusoidal pressures applied at the source well may be processed and/or analyzed in view of the sinusoidal pressures and other filtered values from other receiver wells, if any, to obtain values indicative of the physical properties of the subsurface formation between the source well and the receiver well(s).

In one example of using the filtered values to determine transmissivity and storativity of the subsurface formation (e.g., phasor coefficients for the subsurface formation), a two-dimensional (2D) axisymmetric model may be utilized. Given the filtered values (e.g., the simulated Fourier (phasor) coefficients), we may solve the following equation for transmissivity (T) [m^2/s] and storativity (S) [−]:

$$u = \sqrt{\frac{\omega S r^2}{2T}} \tag{8}$$

where ω is angular frequency [s^−1] of pressure at the source well during testing and is equal to $$\frac{2\pi}{P},$$

where P is the period, in seconds (s), of the sinusoidal pressure applied to the source well during testing, and r is a distance (in meters) (e.g., a radius) between a location of a source well 38 and a receiver well 40. The simulation of the Fourier (phasor) coefficients may be determined from:

$$\varphi_r, \varphi_i = \frac{Q_{max}}{2\pi T} K_0(u + iu) \tag{9}$$

Where $K_0$ is the zeroth-order modified Bessel function of the second kind, i is an imaginary root, and the pumping signal (Q) is represented by:

$$Q(t)-Q_{max}\cos(\omega t) \tag{10}$$

Although the method 300 provide an illustrative technique for determining physical properties of subsurface formation, other suitable techniques are contemplated for use with the system 10. Further, other physical properties in addition to and/or as an alternative to the transmissivity and storativity may be determined, as desired.

The determined physical properties of the subsurface formation may be provided in any suitable manner. For example, the physical properties of the subsurface formation may be provided as a model of the subsurface formation, provided as discrete calculations at locations of sensors, and/or provided in one or more other suitable manners. In one example, the transmissivity of a tested and analyzed subsurface formation be modeled in a heat map having different colors or features representing differences in transmissivity of the subsurface formation at different locations, for example, as discussed in Cardiff, M., Zhou, Y., Barrash, W., Kitanidis, P. K., 2020, Aquifer Imaging with Oscillatory Hydraulic Tomography: Application at the Field Scale. Groundwater 58, 710-722, https://doi.org/10.1111/gwat.12960, which is hereby incorporated in its entirety and for all purposes. In another example, an algorithm may be provided for the model, which may be able to output physical properties of the subsurface formation at three-dimensional coordinates of the subsurface formation.

Example Application Using Oscillatory Hydraulic Tomography Testing

The systems and methods discussed herein may be utilized in Oscillatory Hydraulic Tomography (OHT) subsurface imaging methods. Using numerical tomography experiments in this example, OHT resolution and uncertainty under single and multi-frequency conditions are analyzed with geophysical linearized (i.e., singular value decomposition) and non-linear (i.e., checkerboard testing) approaches.

Oscillatory Hydraulic Tomography (OHT)

In OHT, water or other fluid may be alternately injected into and pumped out of a subsurface formation in a periodic manner at a prescribed frequency. A signal of the periodic pumping into and/or out of a subsurface formation may be recorded and represented by an arriving pressure sinusoid within amplitude and phase delay that may be described by one or more Fourier coefficients. In a two-dimensional (2d) aquifer, the ground water flow equation, in a frequency domain, becomes:

$$i\omega S\varphi=\nabla\cdot(T\nabla\varphi)+q \tag{11}$$

where S is storativity and Tis transmissivity. The term ω is the angular frequency in radiance of pressure in the source well during testing. The term q is a source term and represents a phase-domain oscillatory input source of the form q cos(ωt), where t is time. The term φ represents a hydraulic head response in terms of Fourier coefficients or "phasor".

In field data, head phasors are readily extracted through Fast Fourier Transform (FFT) or least squares analysis. Observed phasors in field data may provide necessary inputs for OHT imaging and forward modeling with inversions may be used to numerically solve the frequency-domain governing equation (e.g., equation (11)).

Figure 7:
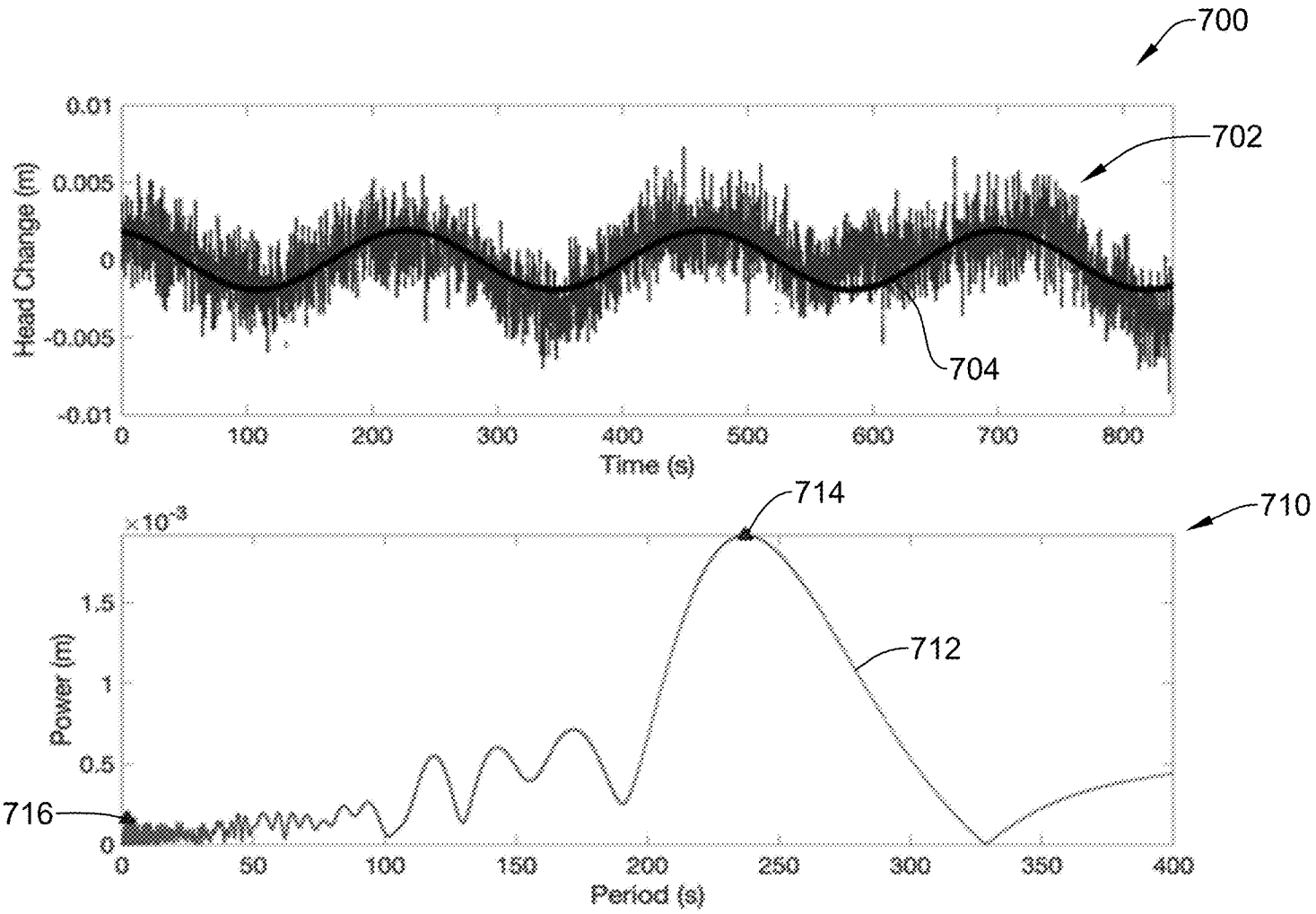
FIG. 7 is a schematic diagram of illustrative oscillatory flow data (top) and corresponding Fourier power spectrum data (bottom)

FIG. 7 depicts two charts 700, 710: 1) the first chart 700 depicts illustrative oscillatory flow data, where the vertical lines 702 represent observed pressure signal data and the smooth curve 704 represents the signal data with noise removed; 2) the second chart 710 depicts a Fourier power spectrum corresponding to the data in the first chart 700, where a max power 714 is at 240 s, corresponding with the observed pressure signal data in the first chart 700, as well as a secondary high-frequency power component 716. The observed pressure signal data depicted in FIG. 7 was recording during OHT procedures with a four (4) minute wave period and ~five (5) millimeter (mm) amplitude signal. The signal contains high frequency Gaussian noise with 0.2 mm amplitude that is easily removed prior to analysis and propagated to parameter uncertainty during inversion using linearized error propagation theory.

As discussed, OHT testing may sample subsurface heterogeneity across multiple scales by changing the frequency of the pumping signal. For example, low frequency signals may be used to sample far-field regions (e.g., regions spaced a distance from a borehole or source well, such as regions between second receiver wells spaced radially outward from first receiver wells radially spaced from a source well) within an aquifer, smoothing out the heterogeneities to create approximately homogeneous amplitude and phase fields, and high frequency signals may be used to sample areas proximate to the borehole or source well (e.g., regions spaced between the source well and the first receiver wells spaced outward from the source well) with significant amplitude attenuation and phase wrapping occurring in the presence of poorly conducting areas within the subsurface.

Figure 8:
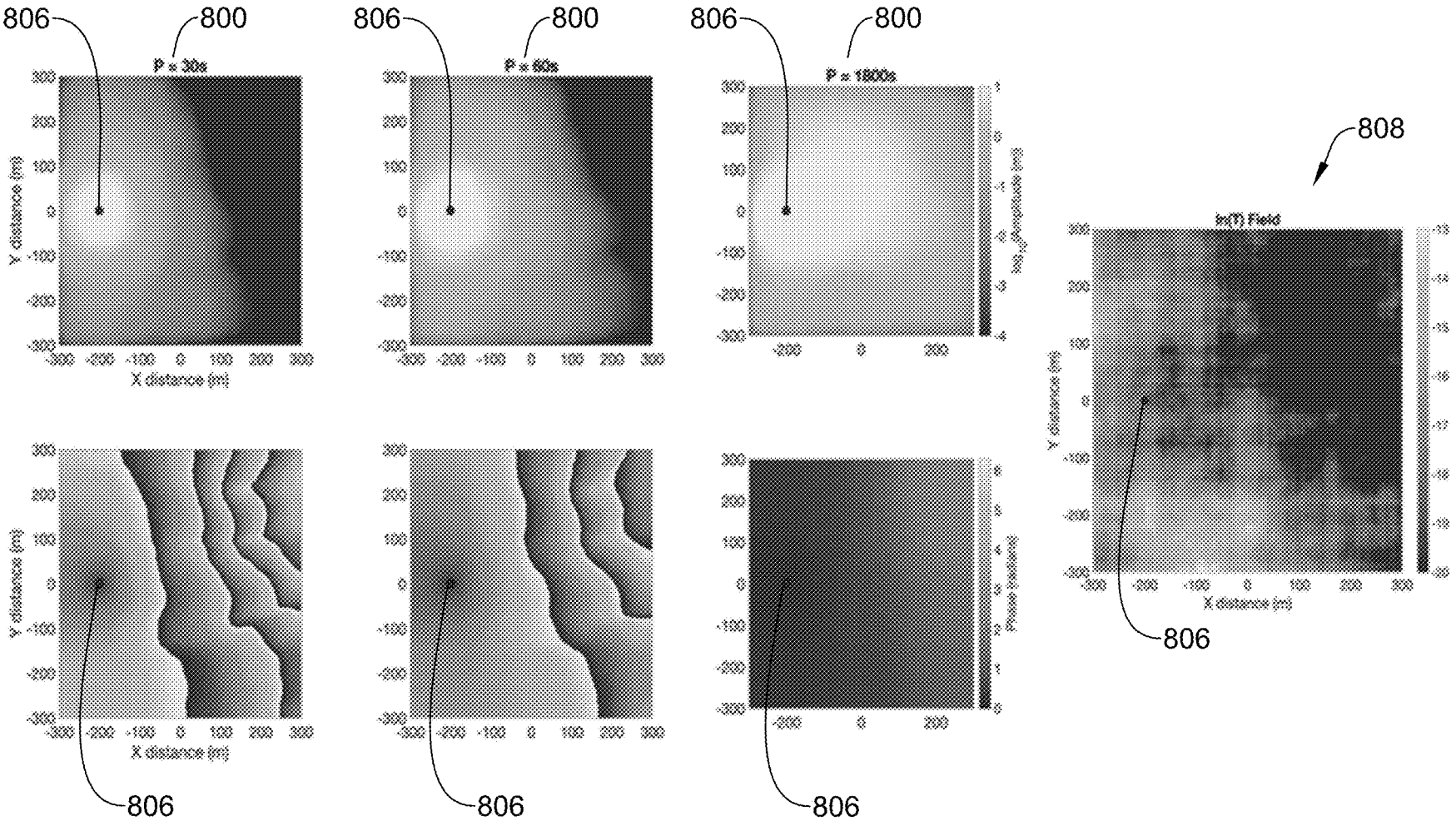
FIG. 8 is a schematic diagram of illustrative amplitude and phase fields.

FIG. 8 depicts illustrations of the OHT testing results using different frequencies of an input signal (e.g., different frequencies of an input pressure at a source well for a field). More specifically, FIG. 8 depicts amplitude fields (top row) and phase fields (bottom row) for synthetic aquifers with pumping frequency (P) 800, 802, 804 at a source well 806 (e.g., a pumping location) decreasing to the right (e.g., from 30 seconds (s) to 60 s to 1800 s). The right-most panel 808 depicts a synthetic transmissivity provided as model inputs to generate the amplitude and phase fields associated with the different pumping frequencies 800, 802, 804.

Inversion Approach

An inversion used to propagate noise to parameter uncertainty may be solved using a quasi-linear geostatistical approach. See e.g., Kitanidis, P. K. (1995), Quasi-Linear Geostatistical Theory for Inversing, *Water Resour. Res.*, 31(10), 2411-2419, doi: 10.1029/95WR10945, which is hereby incorporated by reference in its entirety for any and all purposes. Such an inversion routine may perform forward model runs and full Jacobian updates in an iterative manner to reduce data misfit subject to a geostatistical prior. The geostatistical approach may provide a direct approach to estimate parameter uncertainty. In the routine as applied to the example discussed herein, observation signal measurement error is set to 0.2 mm, which is consistent with noise amplitude in FIG. 7 and prior field data. Linear error propagation theory may then be used to translate time-series measurement error into estimated error in phasor observations that populates the data error covariance matrix for inversion.

To construct the geostatistical prior covariance matrix, we set the field to be a stationary, constant-mean random field described by a linear variogram model:

$$\gamma(h)=-\theta h+\max(h) \tag{12}$$

where −θ is the variogram slope $$\frac{\sigma_s^2}{\max(h)},$$

h is the separation distance or "lag" between locations where aquifer parameters are to be estimated, and $\sigma_s^2$ is a minimum parameter variability. The inversion may be regularized to determine the minimum parameter variability, $\sigma_s^2$, that fits the observed phasor data within a threshold of estimated phasor error magnitude using an L-curve approach.

Resolution and Uncertainty Analysis

Figure 10:
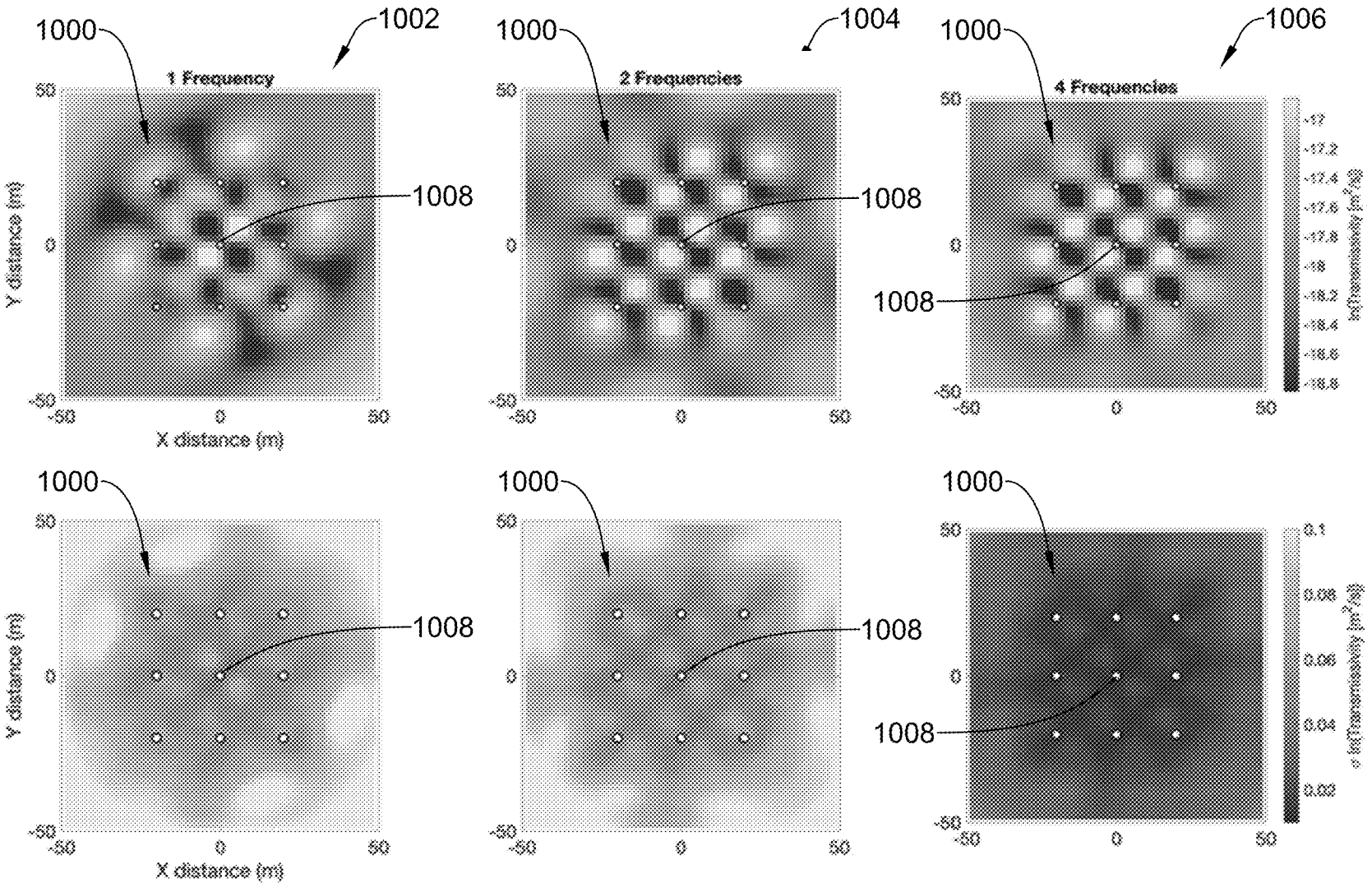
FIG. 10 is a schematic diagram of illustrative recovered checkerboard data (top) and parameter variance data (bottom) for single and multi-frequency inversions.

To interpret and understand data from the multi-frequency OHT testing, a linearized approach may be utilized for singular value analysis and a non-linear approach may be utilized for checkerboard testing to explore OHT resolution and uncertainty. For these analyses, a synthetic 2D variable aperture fracture plane with 9 wells arranged in a 3 by 3 regular grid pattern with 20 m spacing between adjacent wells, forming well fields 1000 as depicted in FIG. 10 (e.g., with recovered checkerboard data in the top row and parameter variance data in the bottom row), where a variable aperture field is in a checkerboard pattern with a checker size of 10 m. During OHT testing, the pumping location (e.g., the source well) is rotated across all wells to generate multiple source well-receiver well pairs, without considering any reciprocal tests. For each frequency component considered there a total of 36 oscillatory flow tests for a total of 72 data points (real and imaginary phasor coefficients).

Singular Value Analysis

Singular value decomposition is a method of analyzing and solving ill-conditioned linear inverse problems. Assuming local linearity, linear methods may be applied to the model Jacobian matrix and how the number and magnitude of non-zero singular values changes as we increase the number of frequency components included in the OHT analysis may be explored.

Figure 9:
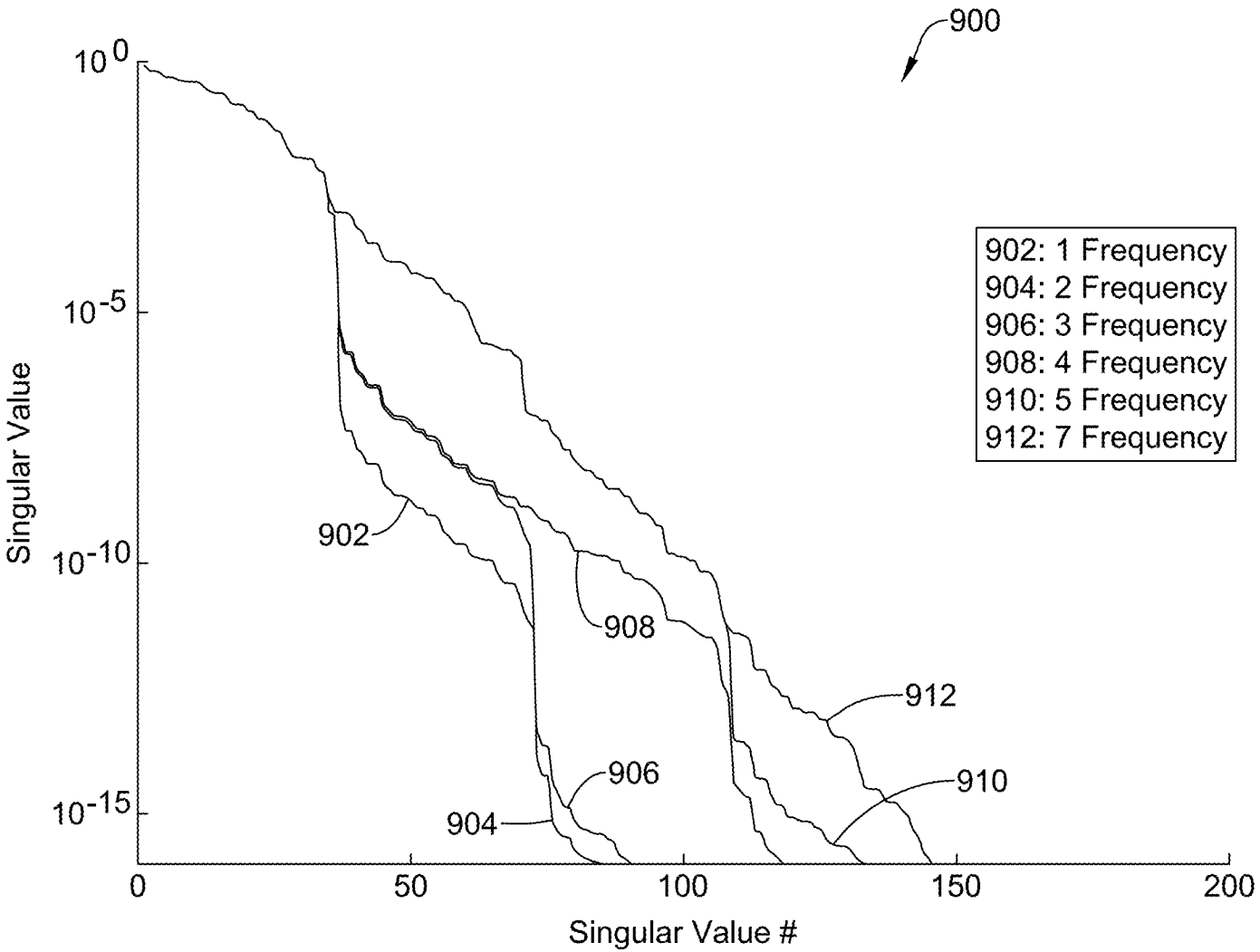
FIG. 9 is a schematic diagram of illustrative singular value analysis data for single and multi-frequency Oscillatory Hydraulic Tomography (OHT) testing.

Using this linearized approach, a singular value decomposition (SVD) may be conducted on the full model Jacobian matrix for OHT analysis, from single frequency testing up to seven frequencies. Generally, the magnitude of some singular values increase with the addition of each new pumping frequency, demonstrating increased information content, as depicted by the lines 902, 904, 906, 908, 910, 912 each associated with a different number of frequencies in the chart 900 of FIG. 9.

Checkerboard Testing

Building on the linearized singular value analysis, a checkerboard test is implemented to further explore subsurface imaging resolution and uncertainty in single- and multi-frequency testing. The OHT analysis for a checkerboard test uses the modeling domain (e.g., phase and/or frequency domains) and inversion approach described above. Following inversion, parameter uncertainty may be estimated by calculating and extracting diagonal elements (i.e., parameter variance) of the posterior covariance matrix. See e.g., Kitanidis (1995), which has been incorporated by reference in its entirety for any and all purposes.

With single frequency OHT analysis, there is good checkerboard recovery surrounding a central well 1008, but with checkerboard blurring moving towards the edges and beyond the well field 1000, as depicted in a first column 1002 of FIG. 10. When using four frequencies during OHT analysis, there is good checkerboard recovery throughout the well field 1000 and checkerboard recovery beyond the well field 1000 blurring in the upper left and lower right corners, as depicted in the columns 1002, 1004, 1006 of FIG. 10. Additionally, there is an increase in checkerboard recovery in the upper left corner and the lower right corner of the well field 1000 for the 4-frequency test compared with the well field 1000 for the 2-frequency OHT analysis, depicted in a second column 1004 of FIG. 10. Similar to the observed resolution improvements, decreases in estimated uncertainty were identified (e.g., by the diagonal elements of the posterior covariance matrix) as being associated with increases in the number of frequency components considered during inversion.

With single frequency OHT analysis, the area of low parameter uncertainty is confined to the area within the well field 1000. The parameter uncertainty decreases within the well field 1000 as well as expanding beyond the well field 1000 when a second frequency component is considered, as depicted when comparing the first column 1002 associated with one frequency to the second column 1004 associated with two frequencies. Finally, there is a drastic decrease in uncertainty throughout the entire domain when using four frequency components during inversion, as depicted in the third column 1006 relative to the first column 1002 and the second column 1004.

DISCUSSIONS AND CONCLUSIONS

Through the singular value analysis (e.g., as discussed above) it has been identified that using data from multiple frequencies provides unique information to be used during inversion. Further, the above analysis demonstrates that multi-frequency inversion improves checkerboard recovery, supporting the interpretation that incorporating multi-frequency data adds additional and unique information during the inversion process. The above analysis demonstrates that multi-frequency analysis may be utilized to resolve subsurface structures that are approximately one-half the size of the well spacing (e.g., see FIG. 10).

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A system, comprising:

a pump configured to be positioned proximate a wellhead of a source well to extract fluid from and inject fluid into the source well;

a data collection system configured to monitor one or more measures indicative of an amount of liquid in the source well, the data collection system comprising an out-of-liquid source well sensor configured to sense one or more measures indicative of an amount of liquid in the source well and be positioned in the source well while remaining out of the liquid at the source well;

a controller in communication with the pump and the data collection system; and wherein the controller is configured to cause the pump to extract the fluid from and inject the fluid into the source well based on the one or more measures indicative of an amount of liquid in the source well.

2. The system of claim 1, wherein the out-of-liquid source well sensor is configured to sense a measure related to fluid injection and extraction rates at the source well.

3. The system of claim 2, wherein the data collection system comprises an in-liquid source well sensor configured to sense one or more measures indicative of an amount of liquid in the source well and remain in the liquid at the source well during changes in an amount of fluid extracted from and injected into the source well.

4. The system of claim 1, wherein the out-of-liquid source well sensor is configured to sense a measure related to pressure at the source well.

5. The system of claim 1, wherein the data collection system includes at least one receiver well sensor at a receiver well that is spaced a known distance from the source well, the at least one receiver well sensor is configured to sense a measure related to pressure changes at the receiver well in response to fluid injection at the source well, fluid extraction at the source well, or both of fluid injection and fluid extraction at the source well.

6. The system of claim 1, wherein the data collection system includes at least one receiver well sensor at each of a plurality of receiver wells that are spaced a known distance from the source well, the at least one receiver well sensor at each of the plurality of receiver wells is configured to sense a measure related to pressure changes at an associated receiver well.

7. The system of claim 6, wherein the out-of-liquid source well sensor is configured to sense a measure related to fluid injection and extraction rates at the source well.

8. The system of claim 7, wherein the controller is configured to receive data from the out-of-liquid source well sensor, receive data from the receiver well sensors, and produce a model of a subsurface formation between the source well and the plurality of receiver wells based on data received from the out-of-liquid source well sensor and data received from the receiver well sensors.

9. The system of claim 8, wherein the model is configured to identify transmissivity and storativity properties in the subsurface formation.

10. The system of claim 1, further comprising:

a valve; and wherein the controller is in communication with the valve to cause the pump to extract fluid from and inject fluid into the source well in a sinusoidal manner.

* * * * *